US007779933B2

(12) United States Patent
Sihler et al.

(10) Patent No.: US 7,779,933 B2
(45) Date of Patent: Aug. 24, 2010

(54) APPARATUS AND METHOD FOR STEERING A DRILL BIT

(75) Inventors: Joachim Sihler, Cheltenham (GB); Partha Ganguly, Woburn, MA (US); Murat Ocalan, Boston, MA (US)

(73) Assignee: Schlumberger Technology Corporation, Cambridge, MA (US)

( * ) Notice: Subject to any disclaimer, the term of this patent is extended or adjusted under 35 U.S.C. 154(b) by 0 days.

(21) Appl. No.: 12/112,011

(22) Filed: Apr. 30, 2008

(65) Prior Publication Data

US 2009/0272579 A1 Nov. 5, 2009

(51) Int. Cl.
*E21B 7/04* (2006.01)

(52) U.S. Cl. ..... 175/61; 175/65; 175/73

(58) Field of Classification Search ..... 175/76, 175/61, 65, 73; 188/267.2
See application file for complete search history.

(56) References Cited

U.S. PATENT DOCUMENTS

| | | | |
|---|---|---|---|
| 5,033,557 | A | 7/1991 | Askew |
| 5,113,953 | A | 5/1992 | Noble |
| 5,265,682 | A | 11/1993 | Russell et al. |
| 5,520,255 | A | 5/1996 | Barr et al. |
| 5,553,678 | A | 9/1996 | Barr et al. |
| 5,553,679 | A | 9/1996 | Thorp |
| 5,582,259 | A | 12/1996 | Barr |
| 5,603,385 | A | 2/1997 | Colebrook |
| 5,673,763 | A | 10/1997 | Thorp |
| 5,685,379 | A | 11/1997 | Barr et al. |
| 5,695,015 | A | 12/1997 | Barr et al. |
| 5,706,905 | A | 1/1998 | Barr |
| 5,778,992 | A | 7/1998 | Fuller |
| 5,803,185 | A | 9/1998 | Barr et al. |
| 5,971,085 | A | 10/1999 | Colebrook |
| 6,089,332 | A | 7/2000 | Barr et al. |
| 6,092,610 | A | 7/2000 | Kosmala et al. |
| 6,158,529 | A | 12/2000 | Dorel |
| 6,244,361 | B1 | 6/2001 | Comeau et al. |
| 6,364,034 | B1 | 4/2002 | Schoeffler |
| 6,394,193 | B1 | 5/2002 | Askew |
| 6,626,248 | B1 | 9/2003 | Roberts |
| 7,360,610 | B2 * | 4/2008 | Hall et al. ..... 175/61 |

(Continued)

OTHER PUBLICATIONS

Patent Cooperation Treaty, International Search Report, dated Dec. 18, 2009, 3 pages.

*Primary Examiner*—William P Neuder
*Assistant Examiner*—Catherine Loikith
(74) *Attorney, Agent, or Firm*—Brigid Laffey; James McAleenan; Vincent Loccisano

(57) ABSTRACT

Steerable drilling systems for facilitating drilling according to a prescribed, three-dimensional trajectory are described. Steering may be achieved using passive actuators which require little or no power. For example, damping elements which couple a drill bit to a drill collar can be used to tilt the drill bit with respect to the drill collar. Alternatively, rotary cutting elements disposed on the drill bit may be used to control the force between the drill bit and the formation at different axial locations. The passive elements used to control the tilt or rotation of the rotary cutting elements are actuated in a certain pattern, e.g., geostationary, in order to achieve a desired deviation of the well bore while drilling ahead. One way to achieve this is through the use of field-sensitive materials, e.g. magnetorheological (MR) fluids, that change viscosity in response to an applied magnetic field.

22 Claims, 8 Drawing Sheets

U.S. PATENT DOCUMENTS

2001/0052428 A1 12/2001 Larronde et al.
2002/0011359 A1 1/2002 Webb et al.
2004/0238219 A1 12/2004 Nichols et al.
2004/0262044 A1* 12/2004 Schaaf ..... 175/61
2005/0194183 A1 9/2005 Gleitman et al.

* cited by examiner

APPARATUS AND METHOD FOR STEERING A DRILL BIT

FIELD OF THE INVENTION

This invention is generally related to borehole drilling systems, and more particularly to steering a drill bit to achieve a desired borehole trajectory.

BACKGROUND OF THE INVENTION

It is sometimes desirable to be able to control the trajectory of a borehole formed during drilling operations. A planned trajectory may be calculated before drilling based on geological data. Various steering techniques and equipment can be employed to achieve the planned trajectory. For example, a bottom hole assembly including a drill bit, stabilizers, drill collars, a mud motor, and a bent housing connected to a drill string can be steered by sliding the assembly with the bend in the bent housing in a specific direction to cause a change in the borehole direction. The assembly and drill string are permitted to rotate in order to drill a linear borehole. Alternatively, non-rotating stabilizers that push radially against the side of the borehole can be used to cause the bit to drill in the opposite direction at a controlled rate while drilling ahead. Another steering system uses pads to push off the side of the borehole in a specific direction as the bottom hole assembly rotates in the hole in order to alter the direction of the borehole. It would nevertheless be desirable to improve upon any of reliability, turn radius, and ease of use.

SUMMARY OF THE INVENTION

In accordance with an embodiment of the invention, apparatus for creating a borehole comprises: a drill bit having at least one cutting member; and at least one resistive damping element operative to control resistance to force between the drill bit and borehole wall due to drill string weight such that an imbalance of resistance at a geostationary reference causes non-linear drilling as the drill bit rotates.

In accordance with another embodiment of the invention, a method for creating a borehole comprises: controlling resistance to force between the drill bit and borehole wall due to drill string weight with at least one resistive damping element and a drill bit having at least one cutting member, such that an imbalance of resistance at a geostationary reference causes non-linear drilling as the drill bit rotates.

An advantage of the invention is that resistive damping elements consume little or no power. The main source of steering power is provided by the weight-force on the bit and rotation of the collar. A damping element based on magnetorheological fluid, for example, can be utilized to control the direction and magnitude of deflection of the drill bit with respect to the collar with the power required to actuate the magnetorheological fluid.

Further features and advantages of the invention will become more readily apparent from the following detailed description when taken in conjunction with the accompanying drawings.

DETAILED DESCRIPTION

Figure 1:
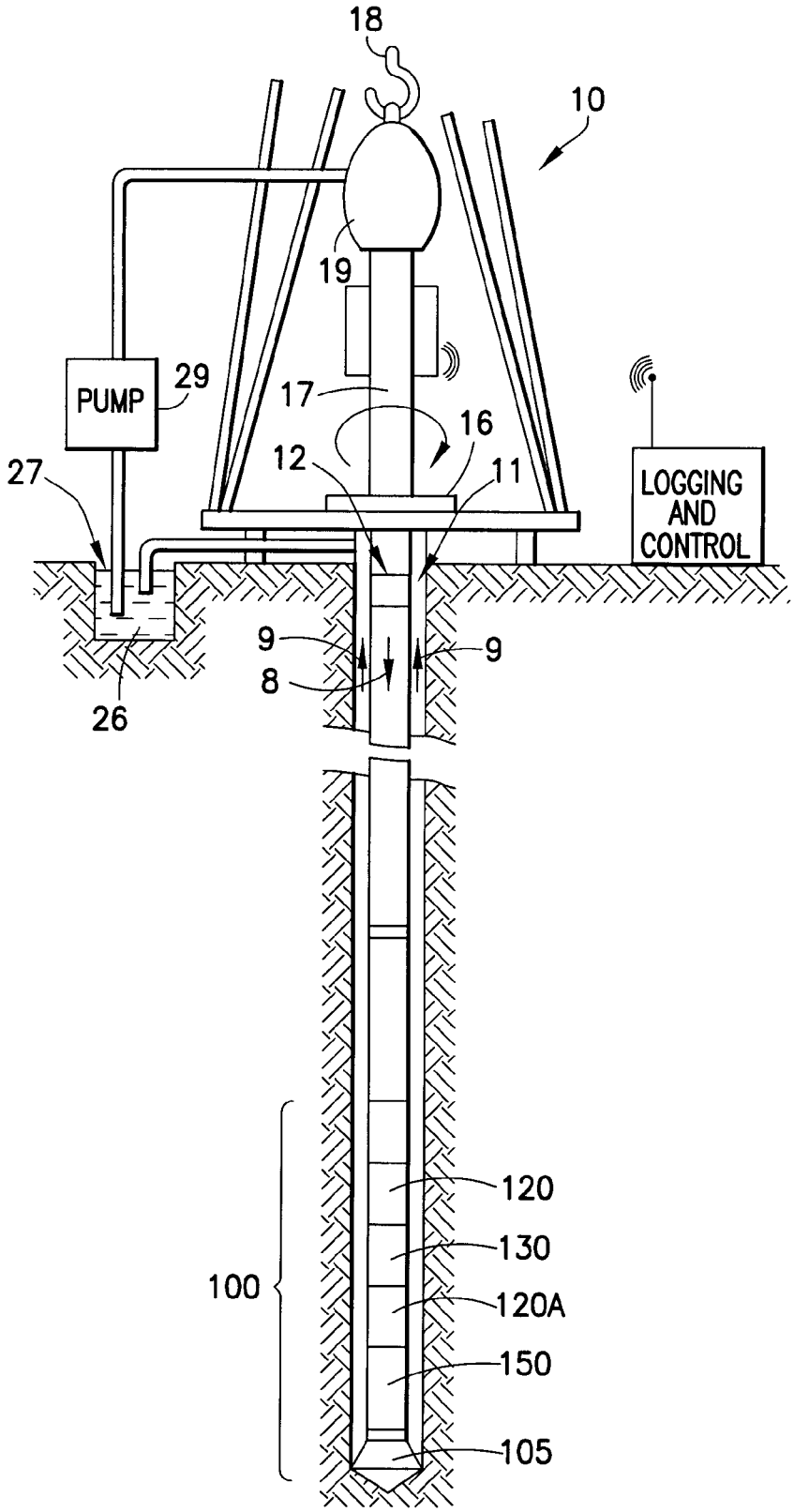
FIG. 1 illustrates a wellsite system in which the present invention can be employed.

FIG. 1 illustrates a wellsite system in which the present invention can be employed. The wellsite can be onshore or offshore. In this exemplary system, a borehole 11 is formed in subsurface formations by rotary drilling in a manner that is well known. Embodiments of the invention can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment a logging-while-drilling (LWD) module 120, a measuring-while-drilling (MWD) module 130, a roto-steerable system and motor, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module includes capabilities for measuring, processing, and storing information, as well as for communicating with the surface equipment. In the present embodiment, the LWD module includes a pressure measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick slip measuring device, a direction measuring device, and an inclination measuring device.

A particularly advantageous use of the system hereof is in conjunction with controlled steering or "directional drilling." In this embodiment, a roto-steerable subsystem 150 (FIG. 1) is provided. Directional drilling is the intentional deviation of the wellbore from the path it would naturally take. In other words, directional drilling is the steering of the drill string so that it travels in a desired direction. Directional drilling is, for example, advantageous in offshore drilling because it enables many wells to be drilled from a single platform. Directional drilling also enables horizontal drilling through a reservoir. Horizontal drilling enables a longer length of the wellbore to traverse the reservoir, which increases the production rate from the well. A directional drilling system may also be used in vertical drilling operation as well. Often the drill bit will veer off of an planned drilling trajectory because of the unpredictable nature of the formations being penetrated or the varying forces that the drill bit experiences. When such a deviation occurs, a directional drilling system may be used to put the drill bit back on course. A known method of directional drilling includes the use of a rotary steerable system ("RSS"). In an RSS, the drill string is rotated from the surface, and downhole devices cause the drill bit to drill in the desired direction. Rotating the drill string greatly reduces the occurrences of the drill string getting hung up or stuck during drilling. Rotary steerable drilling systems for drilling deviated boreholes into the earth may be generally classified as either "point-the-bit" systems or "push-the-bit" systems. In the point-the-bit system, the axis of rotation of the drill bit is deviated from the local axis of the bottom hole assembly in the general direction of the new hole. The hole is propagated in accordance with the customary three point geometry defined by upper and lower stabilizer touch points and the drill bit. The angle of deviation of the drill bit axis coupled with a finite distance between the drill bit and lower stabilizer results in the non-collinear condition required for a curve to be generated. There are many ways in which this may be achieved including a fixed bend at a point in the bottom hole assembly close to the lower stabilizer or a flexure of the drill bit drive shaft distributed between the upper and lower stabilizer. In its idealized form, the drill bit is not required to cut sideways because the bit axis is continually rotated in the direction of the curved hole. Examples of point-the-bit type rotary steerable systems, and how they operate are described in U.S. Patent Application Publication Nos. 2002/0011359; 2001/0052428 and U.S. Pat. Nos. 6,394,193; 6,364,034; 6,244,361; 6,158,529; 6,092,610; and 5,113,953 all herein incorporated by reference. In the push-the-bit rotary steerable system there is usually no specially identified mechanism to deviate the bit axis from the local bottom hole assembly axis; instead, the requisite non-collinear condition is achieved by causing either or both of the upper or lower stabilizers to apply an eccentric force or displacement in a direction that is preferentially orientated with respect to the direction of hole propagation. Again, there are many ways in which this may be achieved, including non-rotating (with respect to the hole) eccentric stabilizers (displacement based approaches) and eccentric actuators that apply force to the drill bit in the desired steering direction. Again, steering is achieved by creating non co-linearity between the drill bit and at least two other touch points. In its idealized form the drill bit is required to cut side ways in order to generate a curved hole. Examples of push-the-bit type rotary steerable systems, and how they operate are described in U.S. Pat. Nos. 5,265,682; 5,553,678; 5,803,185; 6,089,332; 5,695,015; 5,685,379; 5,706,905; 5,553,679; 5,673,763; 5,520,255; 5,603,385; 5,582,259; 5,778,992; 5,971,085 all herein incorporated by reference.

Figure 2:
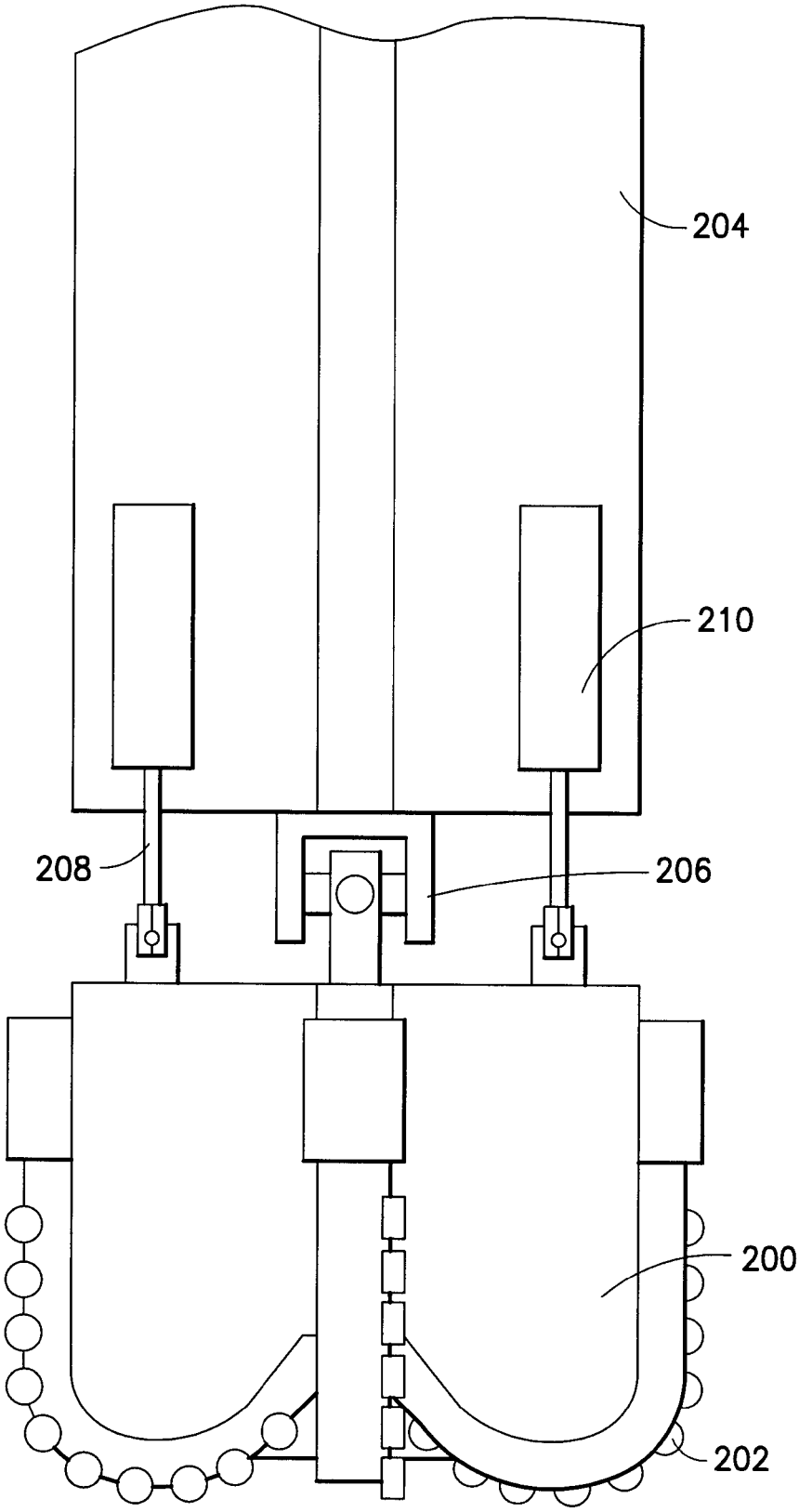
FIGS. 2 and 3 illustrate one embodiment of a steerable drill bit.
Figure 3:
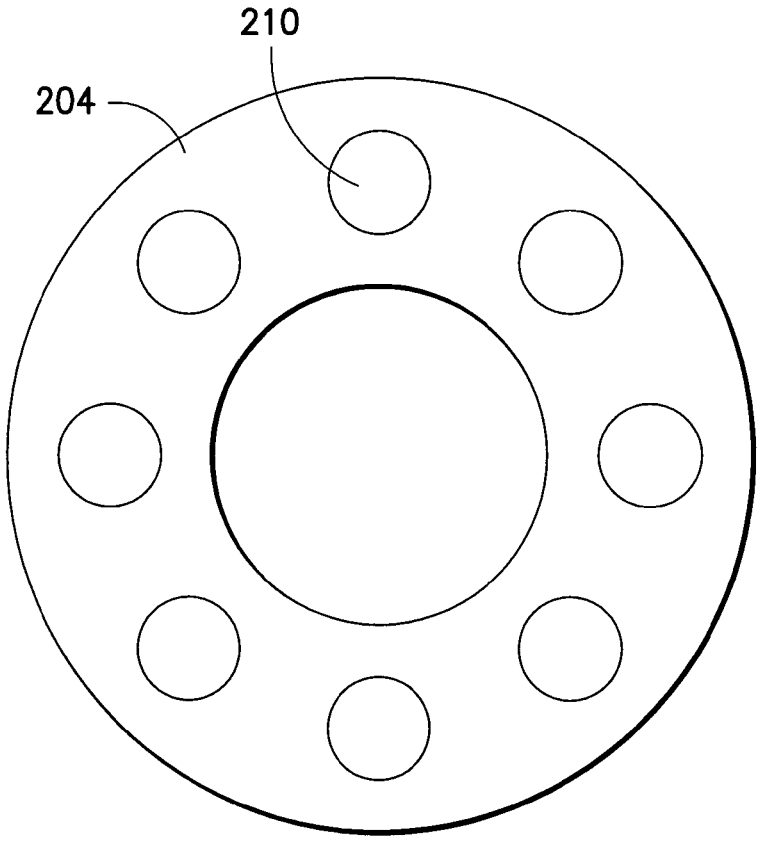

FIGS. 2 and 3 illustrate one embodiment of a steerable drill bit. The steerable drill bit (200) includes a plurality of teeth (202) that abrade the formation when the drill bit is rotated. The drill bit (200) is coupled to a drill collar (204) via a torque and axial load transmitting element (206) and linkage (208) associated with at least one damping element (210). The load transmitting element (206), which may include a universal joint, permits tilting of the drill bit (200) with respect to the drill collar (204). The direction and magnitude of the drill bit tilt with respect to the drill collar is controlled by the damping elements (210). In particular, the distance between the drill bit and the drill collar at a given axial location is a function of extension/retraction of the damping element linkage (208).

The basic principle of operation of the illustrated steerable drill bit is that the damping elements (210) are coordinated to provide a selected magnitude and direction of tilt as the drill bit rotates. This may be achieved by adjustably controlling the stiffness, damping coefficient, or other characteristics of the damping elements in order to control the magnitude of extension of the linkages. For example, in order to drill a vertical segment of borehole the damping elements could be set to have equal extension of the linkages (208). In order to steer in a selected direction, the linkage located proximate to the inside radius of the trajectory is retracted, or the linkage located proximate to the outside radius of the trajectory is extended, or both. Note that the other linkages would necessarily be adjusted, although to a lesser magnitude. As the bit is rotated, the extension and retraction of the linkages is coordinated so that the direction of tilt, and thus the side-force, remains adequately constant to achieve the desired trajectory. In particular, the damping elements are actuated in a geostationary pattern in order to achieve the appropriate deviation of the borehole while drilling ahead.

Figure 4:
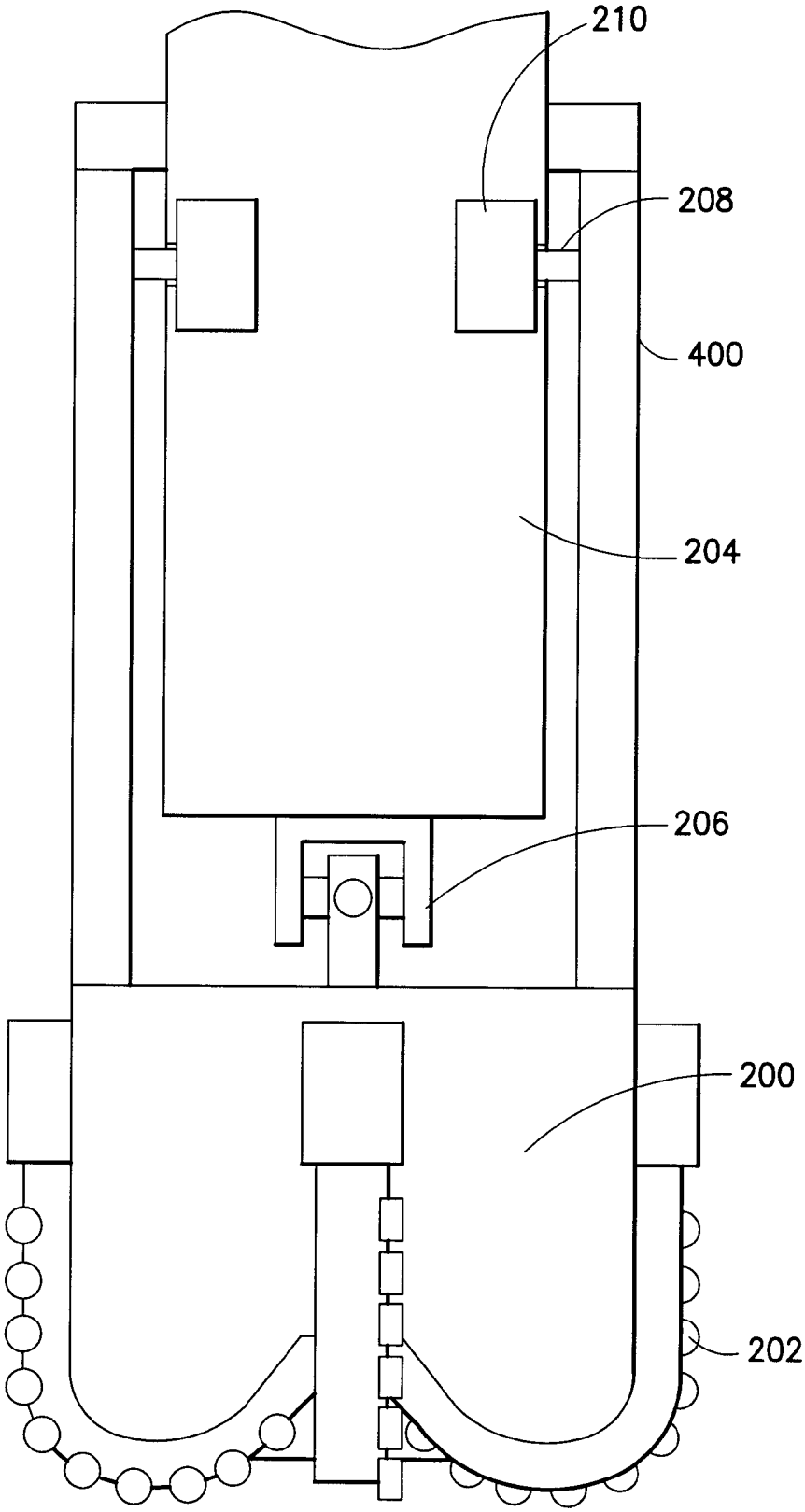
FIG. 4 illustrates an alternative embodiment of the steerable drill bit.

FIG. 4 illustrates an alternative embodiment of the steerable drill bit. In this embodiment the drill bit (200) is also coupled to the drill collar (204) via a torque and axial load transmitting element (206) such as a universal joint. However, the linkages between the damping elements (210) and the drill collar (204) are offset by 90° in comparison with the embodiment illustrated in FIG. 2. In particular, the linkages are coupled to an extension collar (400) rigidly coupled to the drill bit (200). It will be appreciated that coordinated actuation of the damping elements varies the deflection of the drill bit with regard to the drill collar in both direction and magnitude in a manner analogous to that already described above.

Figure 5:
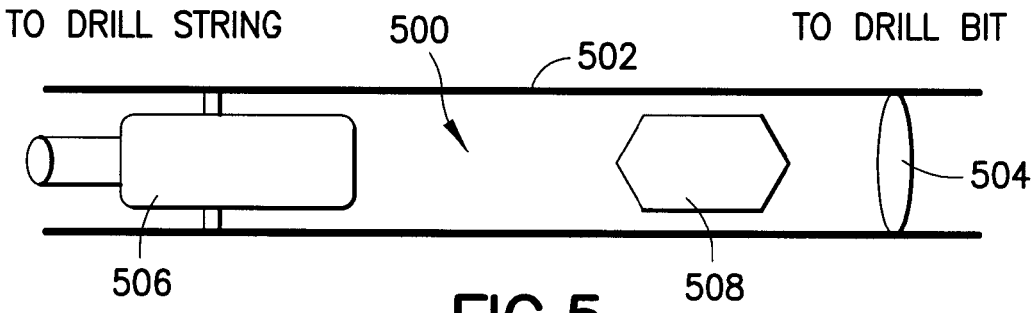
FIG. 5 illustrates a passive valve provided by using a field-sensitive material such as a magnetorheological fluid that changes viscosity in response to applied magnetic field.

Those skilled in the art will recognize that various devices may be utilized to implement the damping elements (210). For example, valves which control fluid flow might be utilized. In accordance with at least one embodiment of the invention the damping elements are passive devices which function by adjusting resistance to force rather than active application of force. As illustrated in FIG. 5, a passive valve may be provided by using a field-sensitive material such as a magnetorheological fluid (500) that changes viscosity in response to applied magnetic field. The magnetorheological fluid is maintained in a cylinder (502) having a sliding movable seal member (504) at one end and a piston (506) at another end. The piston is coupled to the drill string, and the cylinder is coupled to the drill bit. An area reducer element (508) may be disposed within the cylinder to reduce the cross-sectional area of the cylinder with respect to fluid flow. The valve is actuated in response to change in viscosity of the magnetorheological fluid within the cylinder. In particular, a seal is created by the magnetorheological fluid between the reducer element (508) and the cylinder (502). Creation of the seal between the reducer element (508) and the cylinder (502) inhibits movement of fluid, thereby inhibiting movement of the piston (506). When the seal is removed, e.g., by removing the magnetic field, the piston is not inhibited from moving. It will therefore be apparent that the resistive force which the piston exerts in opposition to movement is a function of the level of sealing, i.e., the rate at which fluid is permitted to move between the chamber defined by the reducer element. As a result, movement of the piston within the cylinder, and the resistive force exerted against the drill bit, can be controlled in response to control of the viscosity of the magnetorheological fluid. Further, the viscosity of the magnetorheological fluid can be controlled by application of a magnetic field, i.e., lines of flux, to the fluid, which can be implemented with an electromagnetic coil.

Figure 6:
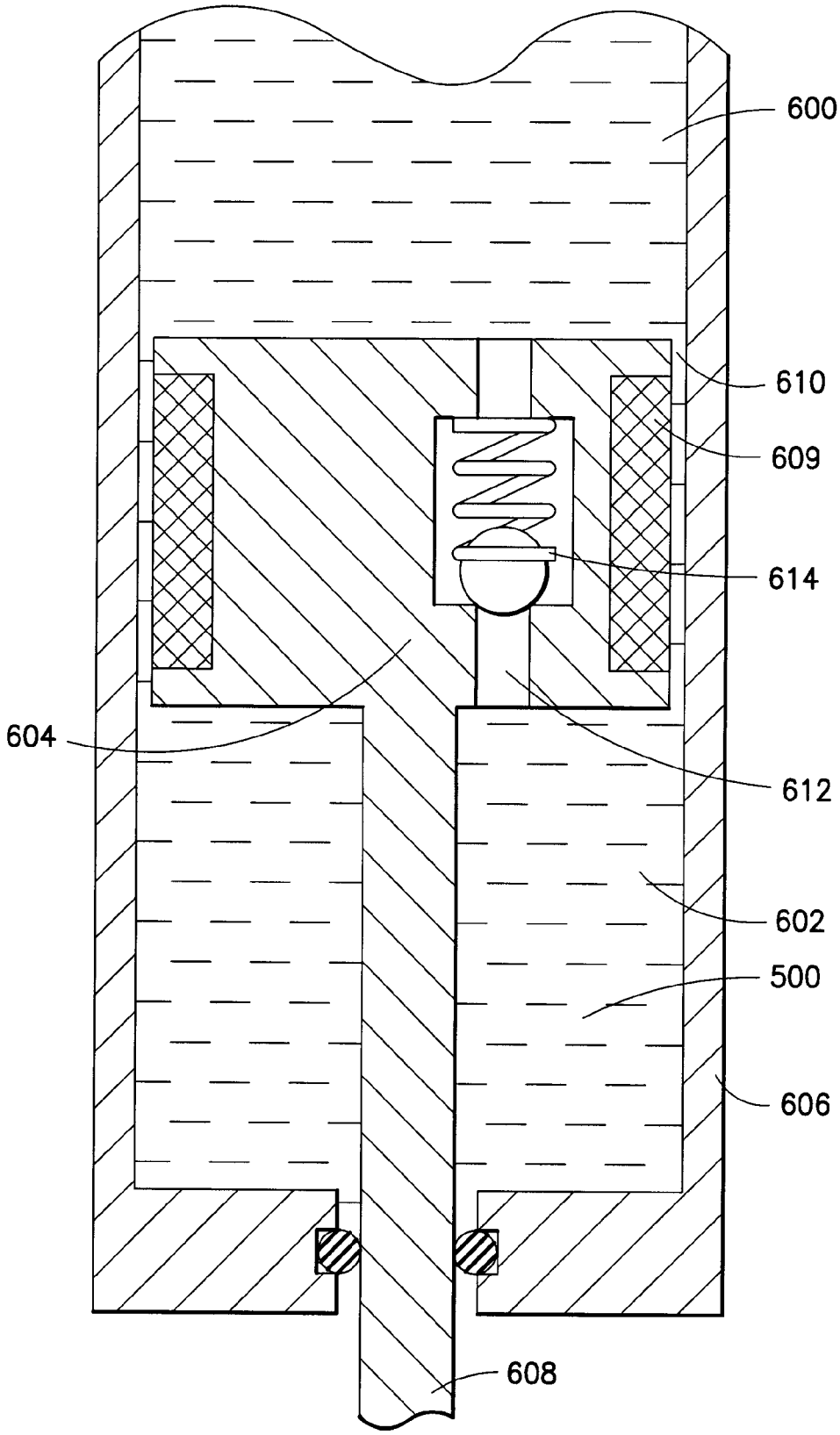
FIG. 6 illustrates an alternative embodiment of the damper.

FIG. 6 illustrates an alternative embodiment of the damper, including a feature for facilitating return stroke recovery rate. Upper and lower chambers (600, 602) are defined by a piston (604) disposed within the cylinder (606). Magnetorheological fluid (500) within the cylinder is forced to move between the different chambers as the damper rod (608) (linkage) is forced in either direction. Because the viscosity of the magnetorheological fluid is dependent upon the magnetic field applied by coil (609), the force required to move the piston (and damper rod) is also a function of applied magnetic field. In this manner, the axial load in the drill string is supported by the resistive force of all dampers. A decrease in the cross-sectional area of the magnetically controlled flow path gap (610) decreases resistance to the axial load by increasing fluid flow rate from the upper chamber to the lower chamber, resulting in movement of the piston further into the upper chamber. In the return stroke, i.e., where the piston moves into the lower chamber, the fluid flows back into the upper chamber. To increase the speed of the return stroke, i.e., recovery, a feature is provided to increase the flow rate between the chambers. Since increasing the annular gap between the piston and the cylinder would result in lower axial force capability, an alternate hydraulic path (612) is provided. The alternate hydraulic path permits fluid flow from the lower chamber to the upper chamber, but restricts flow in the opposite direction in order to maintain high damper force. This may be accomplished with a check valve (614).

Figure 7:
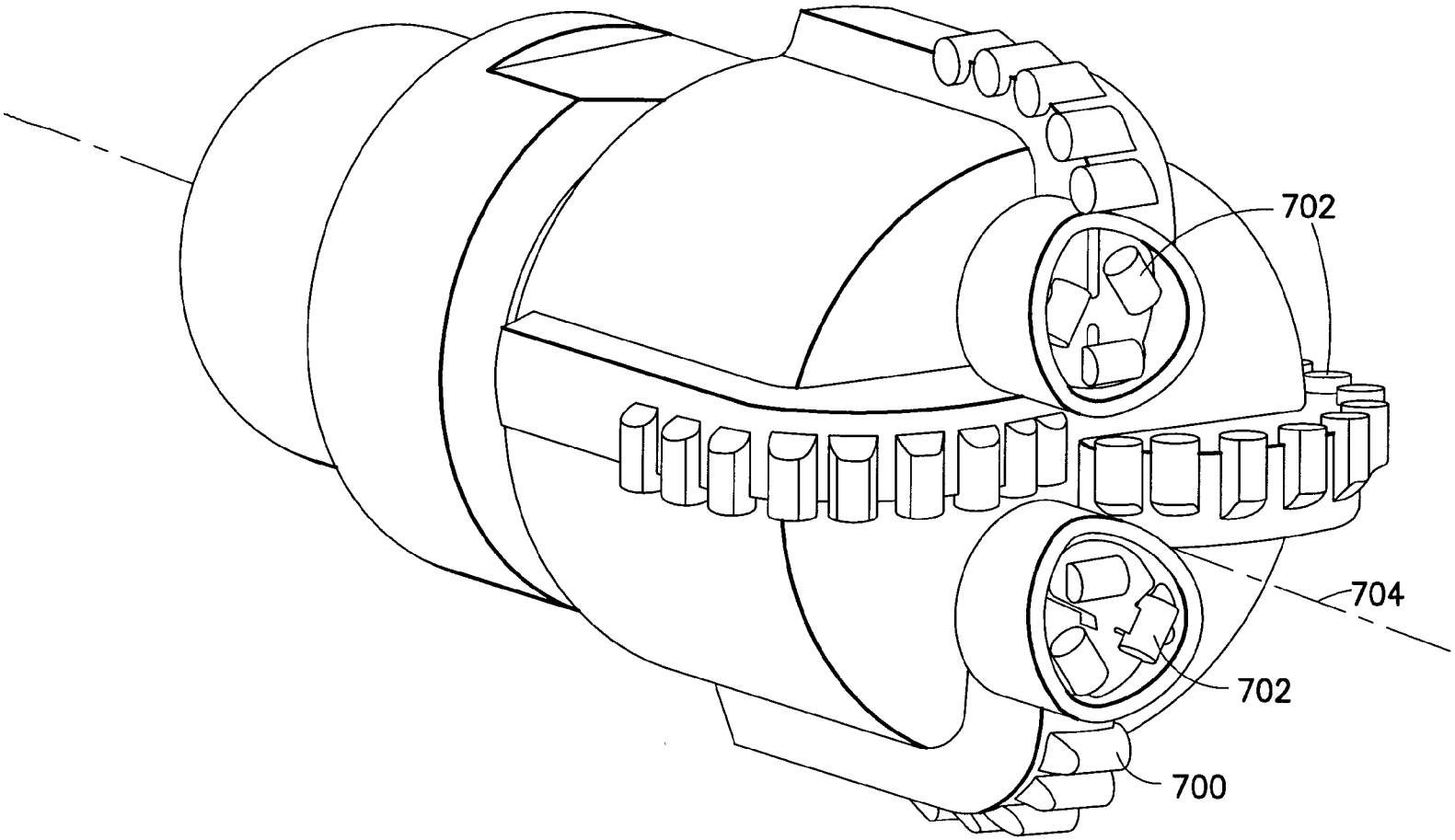
FIGS. 7 and 8 illustrate an alternative embodiment of the drill bit in which PDC cutters and rotary cutting elements are symmetrically placed with respect to the drill bit axis.
Figure 8:
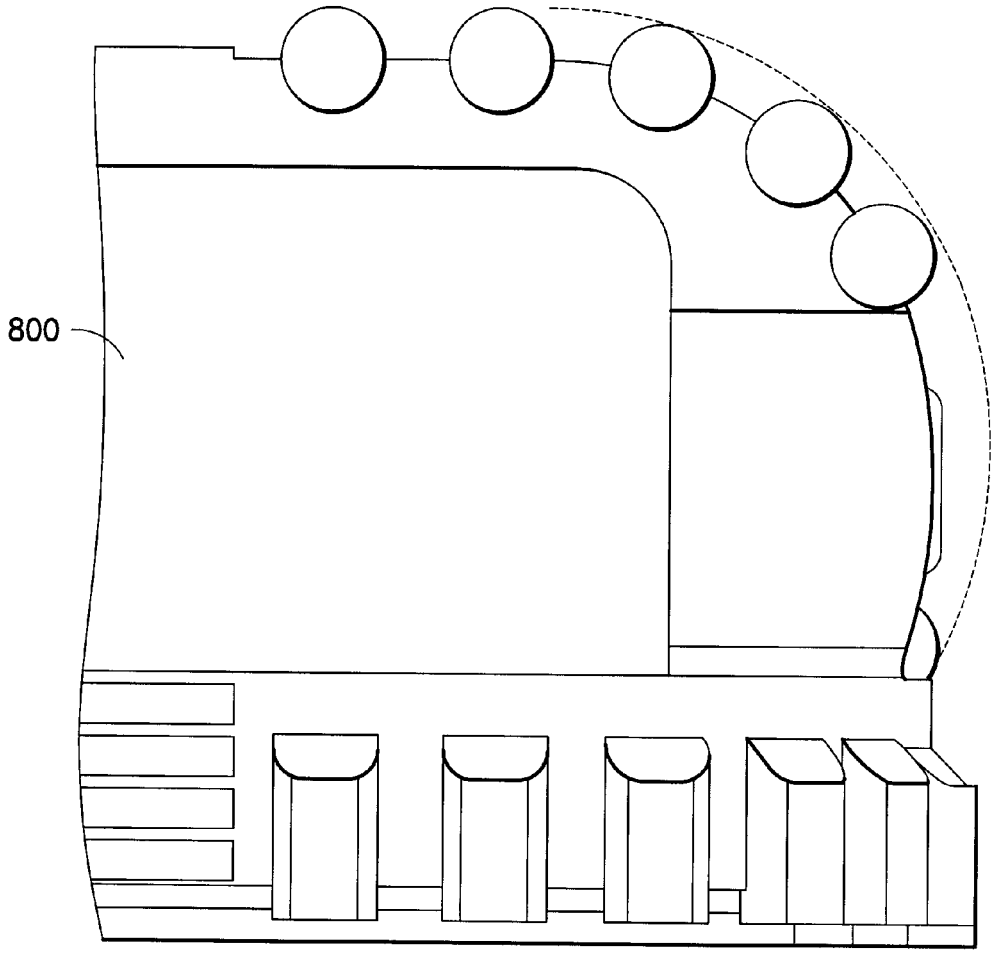

An alternative embodiment of the drill bit is illustrated in FIGS. 7 and 8. This embodiment includes PDC cutters (700) and rotary cutting elements (702) symmetrically placed with respect to the drill bit axis (704). The rotary cutting elements are utilized to facilitate bit steering by creating a controlled imbalance of force between different rotary cutting elements and the adjacent formation. This imbalance of force results in a non-linear drilling path. In order to achieve linear and non-linear drilling, including controlling the radius of the borehole trajectory, each rotary cutting element is independently controllable in terms of rate to rotation. This may be achieved by actively powering rotation or by controlling resistance to rotation induced by the force of the drill bit against the formation, i.e., by applying resistive braking force with a damping element. The control may be either discrete or continuous, and for the resistive implementation may be from freely rotatable to unrotatable. When all of the rotary cutting elements are locked, i.e., unrotatable, the net side-cutting force exerted by the rotary cutting elements is close to zero because the various different cutter forces cancel one another due to symmetrical placement with respect to the drill axis. When the torque on a subset of the rotary cutting elements is lowered to allow for some rotation, i.e., the resistance to rotation is imbalanced between rotary cutting elements, then a net imbalance in side-force between the rotary cutting elements and the formation results. In other words, the imbalance occurs when rate of rotation of the various rotary cutting elements is different, and the magnitude of side force is a function of difference in rate of rotation of the rotary cutting elements.

Having described the basic principle by which an imbalance of force may be created at a given point in time, it will be appreciated that coordinated control of the rotary cutting elements during drill bit rotation can be used to produce a borehole having a desired trajectory, i.e., by controlling the rotational profile of the rotary cutting elements with actuator torque and opposing drilling forces. One possible rotational profile is based on using a geostationary reference. This reference can be used to apply the controlled imbalance force only when a component of the force is directed in the preferred direction. Using this method it is possible to create an average imbalance force on one side of the wellbore by constantly or periodically adjusting the resistance to rotation of all rotary cutting elements, effectively steering the drill bit in the desired direction.

Inserts rotating with a rotary cutting element are periodically oriented in positions where the cutting faces are disposed opposite to the direction of drill bit rotation. In such a position it is undesirable for the cutter inserts to be in contact with the formation because cutter inserts are not typically designed to withstand such forces, and insert efficiency and worklife may be compromised. One technique for avoiding this problem is for the cutters to be offset from the formation when in such an inverted/reverse-biased position. FIG. 8 illustrates an implementation of such an offset. In the illustrated example the curvature of the drill bit (800) provides the offset. An angular offset of the rotary cutting element from the drill bit axis might alternatively be employed. Another option is to position the cutter in close proximity and in front in the drilling direction to the cutters facing the opposite direction. Alternatively, the cutters could be retractable, where a force in the cutting direction does not affect cutter position, but force in the opposite direction pushes the cutter axially inward. This could be accomplished by a mechanical or compliant hinge placed below the cutter.

A three-dimensional borehole trajectory is achieved by coordinated control of the rotational profile of the rotary cutting elements with actuator torque and opposing drilling forces. For example, a profile based on a geostationary reference might be used. The reference can be used to apply the controlled imbalance force only when a component of the force is directed in the preferred direction. Using this method it is possible to create an average imbalance force on one side of the wellbore, effectively steering the drill bit in the desired direction.

Figure 9:
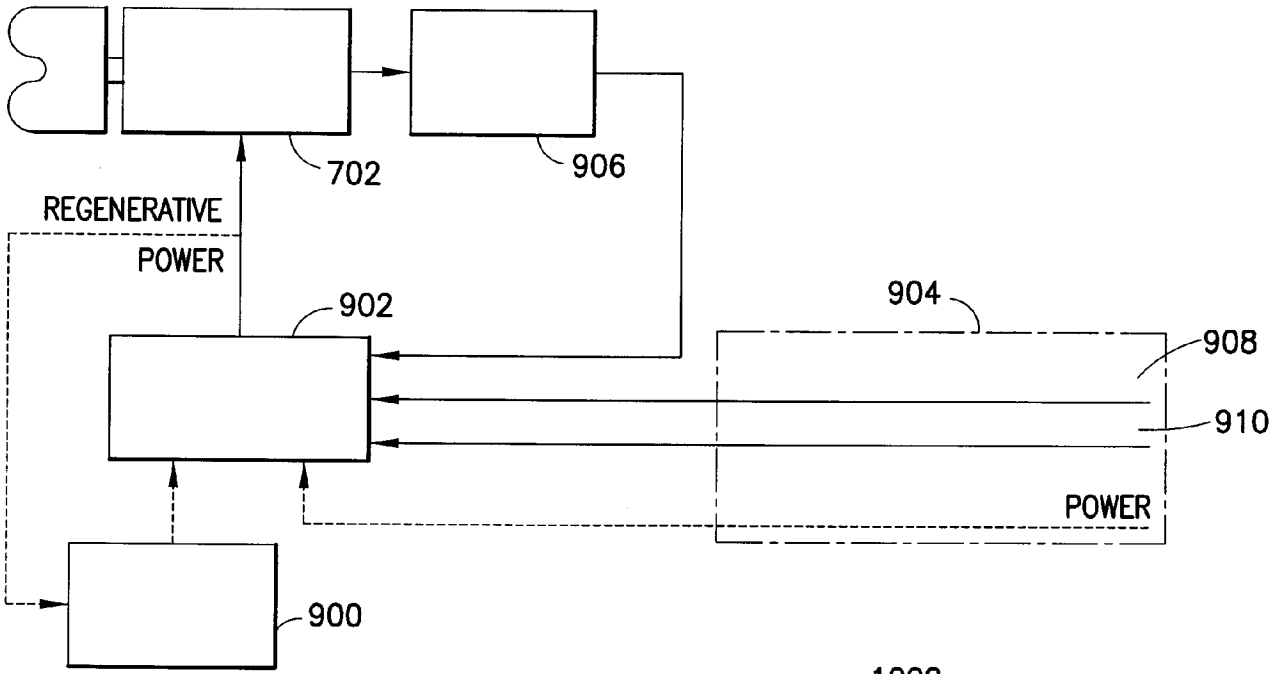
FIG. 9 illustrates a control system for the rotary cutting elements.

FIG. 9 illustrates a control system for the rotary cutting elements. The control system includes at least one power source (900), controller module (902), directional drilling module (904), and sensors (906). The sensors provide information indicative of one or more of acceleration, angular position, angular velocity, and torque, although other information might also be provided. The controller module is operable to adjust control inputs to the rotary cutting element in response to inputs from the sensors and directional drilling module. Because the cutting force exerted on the rotary cutting element is a function of both actuator torque and angular position, the controller module uses a force direction reference (908) and drill bit angular position (910) provided by the directional drilling module, and sensor feedback provided by the sensors, to achieve a desired imbalance force.

The control system may be powered by one or more of the directional drilling module, e.g., power from the surface, stored power, e.g., from a battery or capacitor, regenerative braking power, and hydraulically generated power, e.g., from drill mud flow. For example, because regenerative braking power may tend to vary over time, a secondary power source may be used to supplement power provision. However, if the net power provided via regenerative braking is on average greater than that consumed by the control system, the secondary source might not be required, particularly if power storage is utilized, e.g., excess regenerative power stored in a battery.

Figure 10:
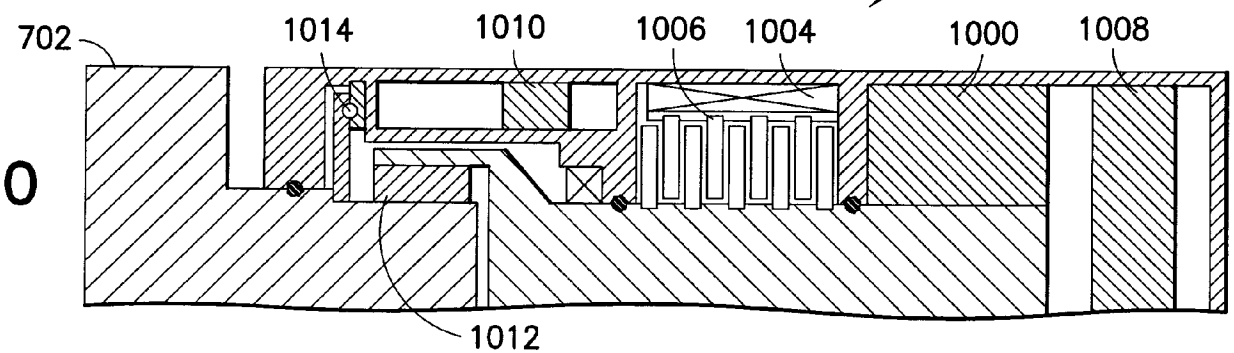
FIG. 10 illustrates an embodiment of a torque actuator with a regenerative braking feature.

FIG. 10 illustrates an embodiment of a torque actuator/damping element with a regenerative braking feature. The torque actuator/damping element may utilize a magnetorheological fluid brake, magnetic brake, mechanical brake, hydraulic brake, electric motor, hydraulic motor, or hybrid actuators utilizing combinations thereof. An electric motor (1000) converts rotation of the rotary cutting element (702) into electrical energy. This energy may be used in a magnetorheological fluid brake (1002) to achieve further braking torque. The magnetorheological fluid brake uses an electromagnetic coil (1004) to convert current into magnetic flux that is directed toward gaps between brake plates (1006) filled with magnetorheological fluid. In the absence of a magnetic field, rotation of the brake is opposed by only negligible force. However, in the presence of a magnetic field the viscosity of the magnetorheological fluid between the brake plates is altered, resulting in braking torque/damping. Because magnetorheological fluid has a tendency to accelerate wear on bearings and seals, a separate fluid might be utilized for the bearings and motor. Due to the pressure and temperature variations in the typical drilling environment, it may be desirable to pressure compensate the enclosed fluids. This can be accomplished with a actuator fluid compensator (1008) and a magnetorheological fluid compensator (1010). Alternatively, it may be possible to compensate magnetorheological fluid directly to wellbore fluids. Because the rotational speeds induced on the rotary cutting elements in drilling operations are commonly lower than the speeds at which electric motors are operate efficiently, a gearbox (1012) may be used to reduce actuator rotation speed. A thrust bearing (1014) may also be used to accommodate axial forces during drilling.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the invention should not be viewed as limited except by the scope and spirit of the appended claims.

What is claimed is:

1. Apparatus for creating a borehole comprising:

a drill bit having at least one cutting member;

at least one resistive damping element operative to control resistance to force between the drill bit and a borehole wall due to drill string weight such that an imbalance of resistance at a geostationary reference causes non-linear drilling as the drill bit rotates; and wherein the drill bit is coupled to a drill collar via the at least one resistive damping element, and wherein the at least one resistive damping element controls direction and magnitude of drill bit tilt with respect to the drill collar.

2. The apparatus of claim 1 including a plurality of resistive damping elements actuated in a geostationary resistance pattern as the drill bit rotates.

3. The apparatus of claim 1 further including the drill collar coupled with a drill string and an extension collar coupled to the drill bit, the drill collar disposed at least partially within the extension collar, and the at least one resistive damping element coupled between the drill collar and the extension collar.

4. The apparatus of claim 1 wherein the damping element includes a valve.

5. The apparatus of claim 1 wherein the valve includes a piston disposed within a cylinder which contains a field-sensitive material such that resistance to piston movement is a function of applied field.

6. The apparatus of claim 5 wherein the field-sensitive material is a magnetorheological fluid.

7. The apparatus of claim 6 further including an alternate fluid path for facilitating piston movement in a return stroke.

8. The apparatus of claim 7 further including a check valve for controlling fluid flow through the alternate fluid path.

9. Apparatus for creating a borehole comprising:

a drill bit having at least one cutting member;

at least one resistive damping element operative to control resistance to force between the drill bit and a borehole wall due to drill string weight such that an imbalance of resistance at a geostationary reference causes non-linear drilling as the drill bit rotates; and wherein the cutting member includes a rotary cutting element for which resistance to rotation is controlled by the at least one resistive damping element.

10. The apparatus of claim 9 wherein the rotary cutting element exerts greater abrasive force against the borehole wall with greater resistance to rotation.

11. The apparatus of claim 9 further including a regenerative braking feature for converting energy from rotation of the rotary cutting element into a form that can be stored.

12. A method for creating a borehole comprising:

controlling resistance to force between a drill bit and a borehole wall due to drill string weight with at least one resistive damping element and the drill bit having at least one cutting member, such that an imbalance of resistance at a geostationary reference causes non-linear drilling as the drill bit rotates; and wherein the drill bit is coupled to a drill collar via the at least one resistive damping element, and including the step of the at least one resistive damping element controlling direction and magnitude of drill bit tilt with respect to the drill collar.

13. The method of claim 12 including the step of actuating a plurality of resistive damping elements in a geostationary resistance pattern as the drill bit rotates.

14. The method of claim 12 further including the drill collar coupled with a drill string and an extension collar coupled to the drill bit, the drill collar disposed at least partially within the extension collar, and the at least one resistive damping element coupled between the drill collar and the extension collar, and including the step of the at least one resistive damping element controlling direction and magnitude of drill bit tilt with respect to the drill collar.

15. The method of claim 12 wherein the damping element includes a valve, and including the step of controlling resistance to force between the drill bit and borehole wall by actuating the valve.

16. The method of claim 12 wherein the valve includes a piston disposed within a cylinder which contains a field-sensitive material, and including the step of actuating the valve through application of a field where resistance to piston movement is a function of applied field.

17. The method of claim 16 wherein the field-sensitive material is a magnetorheological fluid, and including the step of applying a magnetic field to control viscosity of the fluid.

18. The method of claim 17 further including the step of causing fluid to traverse an alternate fluid path for facilitating piston movement in a return stroke.

19. The method of claim 18 including the further step of controlling fluid flow through the alternate fluid path with a check valve.

20. A method for creating a borehole comprising:

controlling resistance to force between a drill bit and a borehole wall due to drill string weight with at least one resistive damping element and the drill bit having at least one cutting member, such that an imbalance of resistance at a geostationary reference causes non-linear drilling as the drill bit rotates; and wherein the cutting member includes a rotary cutting element, and including the further step of controlling resistance to rotation of the rotary cutting element with the at least one resistive damping element.

21. The method of claim 20 including the step of increasing abrasive force between the rotary cutting element and the borehole by increasing resistance to rotation.

22. The method of claim 20 including the step of converting energy from rotation of the rotary cutting element into a form that can be stored.

* * * * *